US006186834B1

(12) United States Patent
Arnett et al.

(10) Patent No.: US 6,186,834 B1
(45) Date of Patent: Feb. 13, 2001

(54) ENHANCED COMMUNICATION CONNECTOR ASSEMBLY WITH CROSSTALK COMPENSATION

(75) Inventors: Jaime Ray Arnett, Fishers; Robert Ray Goodrich, Indianapolis, both of IN (US); Amid Ihsan Hashim, Randolph, NJ (US)

(73) Assignee: Avaya Technology Corp., Miami Lakes, FL (US)

( * ) Notice: Under 35 U.S.C. 154(b), the term of this patent shall be extended for 0 days.

(21) Appl. No.: 09/327,882

(22) Filed: Jun. 8, 1999

(51) Int. Cl.[7] ..... H01R 24/00
(52) U.S. Cl. ..... 439/676; 439/941
(58) Field of Search ..... 439/676, 941, 439/344, 660, 76.1, 404, 405

(56) References Cited

U.S. PATENT DOCUMENTS

| | | | | |
|---|---|---|---|---|
| 5,186,647 | | 2/1993 | Denkmann et al. | 439/395 |
| 5,299,956 | | 4/1994 | Brownell et al. | 439/638 |
| 5,362,257 | * | 11/1994 | Neal et al. | 439/676 |
| 5,547,405 | | 8/1996 | Pinney et al. | 439/894 |
| 5,562,498 | * | 10/1996 | Brandenburg et al. | 439/620 |
| 5,580,270 | | 12/1996 | Pantland et al. | 439/395 |
| 5,967,828 | * | 10/1999 | Geurts et al. | 439/418 |
| 5,975,919 | * | 11/1999 | Arnett et al. | 439/82 |
| 6,042,427 | * | 3/2000 | Adriaenssens et al. | 439/676 |

* cited by examiner

*Primary Examiner*—Brian Sircus
*Assistant Examiner*—Son Nguyen
(74) *Attorney, Agent, or Firm*—Law Office of Leo Zucker

(57) ABSTRACT

An enhanced communication connector assembly capable of meeting Category 6 performance levels with respect to near end crosstalk (NEXT), when the assembly is connected to a mating connector. The assembly includes a wire board, and a number of elongated terminal contact wires with base portions that are supported on the board. The contact wires have free end portions opposite the base portions for making electrical contact with a mating connector. A crosstalk compensating device on the wire board is constructed and arranged to cooperate with sections of selected terminal contact wires to provide capacitive compensation coupling between the selected terminal contact wires, when the contact wires are engaged by the mating connector.

16 Claims, 5 Drawing Sheets

ENHANCED COMMUNICATION CONNECTOR ASSEMBLY WITH CROSSTALK COMPENSATION

BACKGROUND OF THE INVENTION

1. Field of the Invention

This invention relates generally to communication connectors, and particularly to a connector assembly that compensates for crosstalk among different signal paths conducted through the assembly.

2. Discussion of the Known Art

There is a need for a durable, high frequency communication connector assembly that compensates for (i.e., cancels or reduces) crosstalk among and between different signal paths within the assembly. As broadly defined herein, crosstalk occurs when signals conducted over a first signal path, e.g., a pair of terminal contact wires associated with a communication connector, are partly transferred by inductive or capacitive coupling into a second signal path, e.g., another pair of terminal contact wires in the same connector. The transferred signals define "crosstalk" in the second signal path, and such crosstalk degrades any signals that are routed over the second path.

For example, an industry type RJ-45 communication connector has four pairs of terminal wires defining four different signal paths. In typical RJ-45 plug and jack connectors, all four pairs of terminal wires extend closely parallel to one another over the lengths of the connector bodies. Thus, signal crosstalk may be induced between and among different pairs of terminal wires within the typical RJ-45 plug and jack connectors, particularly when the connectors are in a mated configuration. The amplitude of the crosstalk becomes stronger as the coupled signal frequencies or data rates increase.

Applicable industry standards for rating the degree to which communication connectors exhibit crosstalk, do so in terms of so-called near end crosstalk or "NEXT". Moreover, NEXT ratings are typically specified for mated connector configurations, e.g., a type RJ-45 plug and jack combination, wherein the input terminals of the plug connector are used as a reference plane. Communication links using unshielded twisted pairs (UTP) of copper wire are now expected to support data rates up to not only 100 MHz, or industry standard "Category 5" performance; but to meet "Category 6" performance levels which call for at least 46 dB crosstalk isolation at 250 MHz.

U.S. Pat. No. 5,186,647 to Denkmann et al. (Feb. 16, 1993), which is assigned to the assignee of the present invention and application, discloses an electrical connector for conducting high frequency signals. The connector has a pair of metallic lead frames mounted flush with a dielectric spring block, with connector terminals formed at opposite ends of the lead frames. The lead frames themselves include flat elongated conductors each of which includes a spring terminal contact wire at one end for contacting a corresponding terminal wire of a mating connector, and an insulation displacing connector terminal at the other end for connection with an outside insulated wire lead. The lead frames are placed over one another on the spring block, and three conductors of one lead frame have cross-over sections configured to overlap corresponding cross-over sections formed in three conductors of the other lead frame. All relevant portions of the mentioned '647 patent are incorporated by reference herein. U.S. Pat. No. 5,580,270 (Dec. 3, 1996) also discloses an electrical plug connector having crossed pairs of contact strips.

Crosstalk compensation circuitry may also be provided on or within layers of a printed wire board, to which spring terminal contact wires of a communication jack are connected within the jack housing. See U.S. patent application Ser. No. 08/923,741 filed Sep. 29, 1997, and assigned to the assignee of the present application and invention. All relevant portions of the '741 application are incorporated by reference herein. See also U.S. Pat. No. 5,299,956 (Apr. 5, 1994).

U.S. patent application Ser. No. 09/264,506 filed Mar. 8, 1999, and assigned to the assignee of the present application and invention, discloses a communications connector assembly having co-planar terminal contact wires, wherein certain pairs of the contact wires have opposed cross-over sections to provide inductive crosstalk compensation. All relevant portions of the '506 application are also incorporated by reference herein.

Further, U.S. Pat. No. 5,547,405 (Aug. 20, 1996) discloses an electrical connector having signal carrying contacts that are stamped as lead frames from a metal sheet. Certain contacts have integral lateral extensions that overlie enlarged adjacent portions of other contacts to provide capacitive coupling crosstalk compensation. A dielectric spacer is disposed between an extension of one contact and an enlarged adjacent portion of the other contact. Thus, the stamped lead frames for the connector of the '405 patent are complex, and are relatively difficult to manufacture and assemble precisely.

There remains a need for a communication jack connector assembly which, when mated with a typical RJ-45 plug, provides both inductive and capacitive crosstalk compensation such that the mated connectors will meet or surpass Category 6 performance.

SUMMARY OF THE INVENTION

According to the invention, a communications connector assembly includes a wire board, and a number of elongated terminal contact wires each having a base portion supported on the wire board, and a free end portion opposite the base portion to make electrical contact with a mating connector. A crosstalk compensating device on the wire board cooperates with sections of selected terminal contact wires to produce a determined amount of capacitive compensation coupling between the selected terminal contact wires, when the contact wires are engaged by the mating connector.

In one embodiment, the wire board of the communication connector assembly is inserted within a jack housing, and an opening in a front surface of the jack housing is dimensioned for receiving the mating plug connector.

For a better understanding of the invention, reference is made to the following description taken in conjunction with the accompanying drawing and the appended claims.

DETAILED DESCRIPTION OF THE INVENTION

Figure 1:
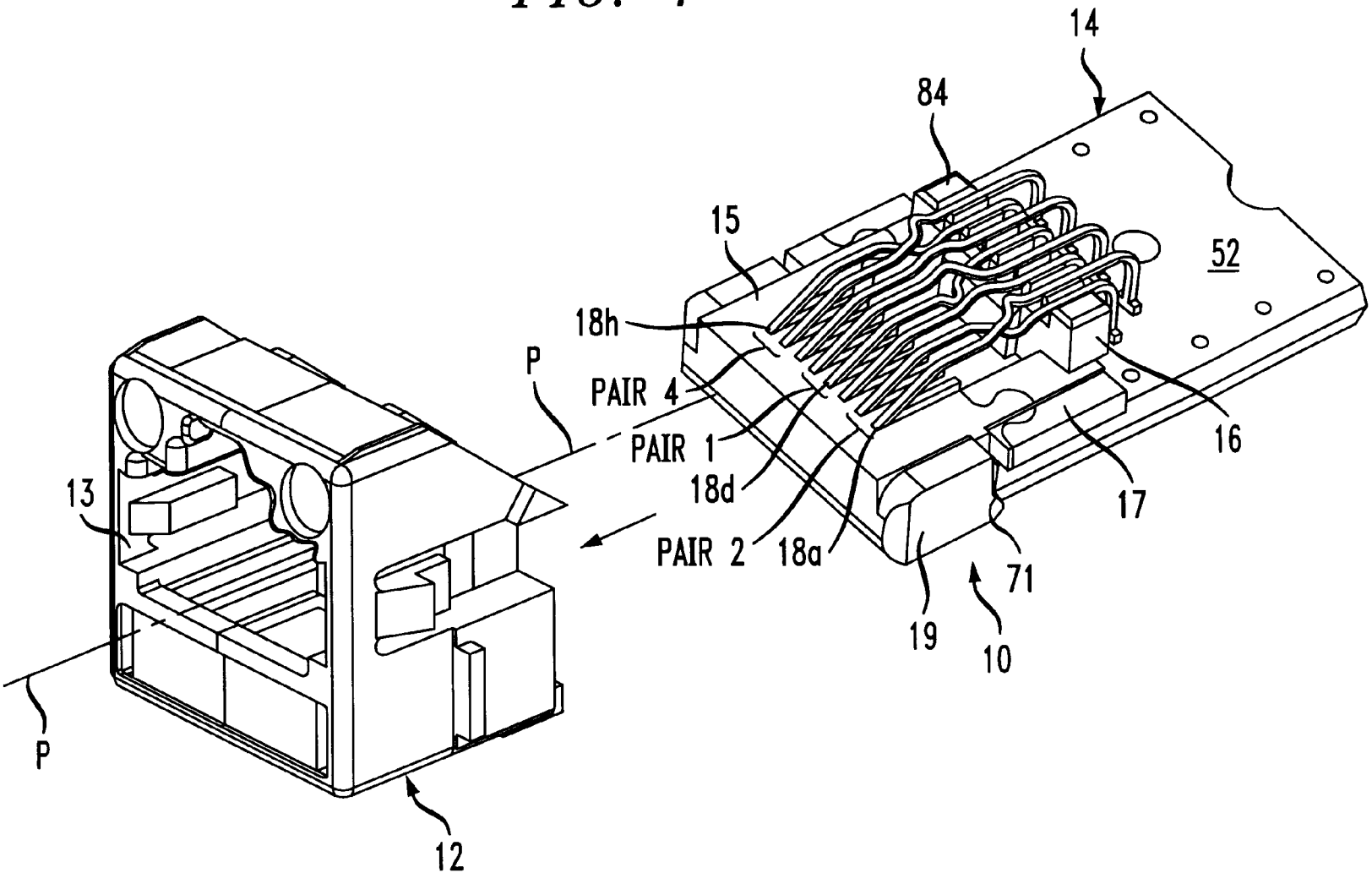
FIG. 1 is a perspective view of a communication connector assembly, and a jack housing into which the assembly can be inserted and mounted.
Figure 2:
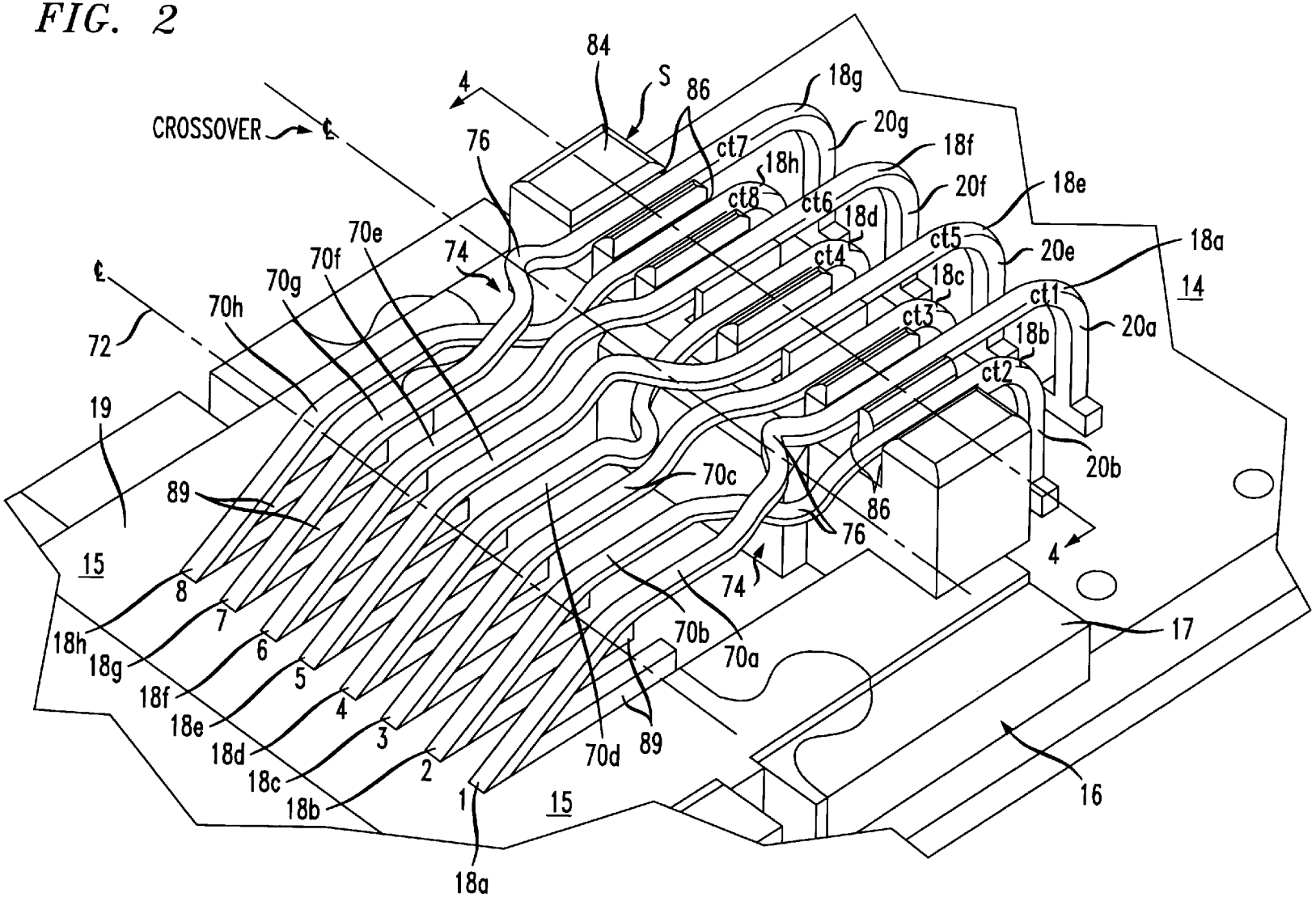
FIG. 2 is an enlarged, perspective view of a front portion of the connector assembly in FIG. 1.

FIG. 1 is a perspective view of an enhanced communication connector assembly 10, and a communication jack frame or housing 12 into which the assembly 10 can be inserted and mounted. The jack housing 12 has a front face in which a plug opening 13 is formed. The plug opening 13 has an axis P, along the direction of which axis a mating plug connector may be inserted into the housing opening 13 to connect electrically with the assembly 10. FIG. 2 is an enlarged, perspective view of a front portion of the connector assembly 10 in FIG. 1.

In the illustrated embodiment, the communication connector assembly 10 has an associated, generally rectangular printed wire board 14. The board 14 may comprise, for example, a single or a multi-layer dielectric substrate. A number, e.g., eight elongated terminal contact wires 18*a*–18*h* emerge from a central portion of the printed wire board 14, as seen in FIG. 1. The contact wires 18*a*–18*h* extend substantially parallel to one another, and are generally uniformly spaced from a top surface 15 of a two-part contact wire guide structure 16. A first support part 17 of the guide structure 16 is fixed on a front portion of the wire board 14.

Figure 3:
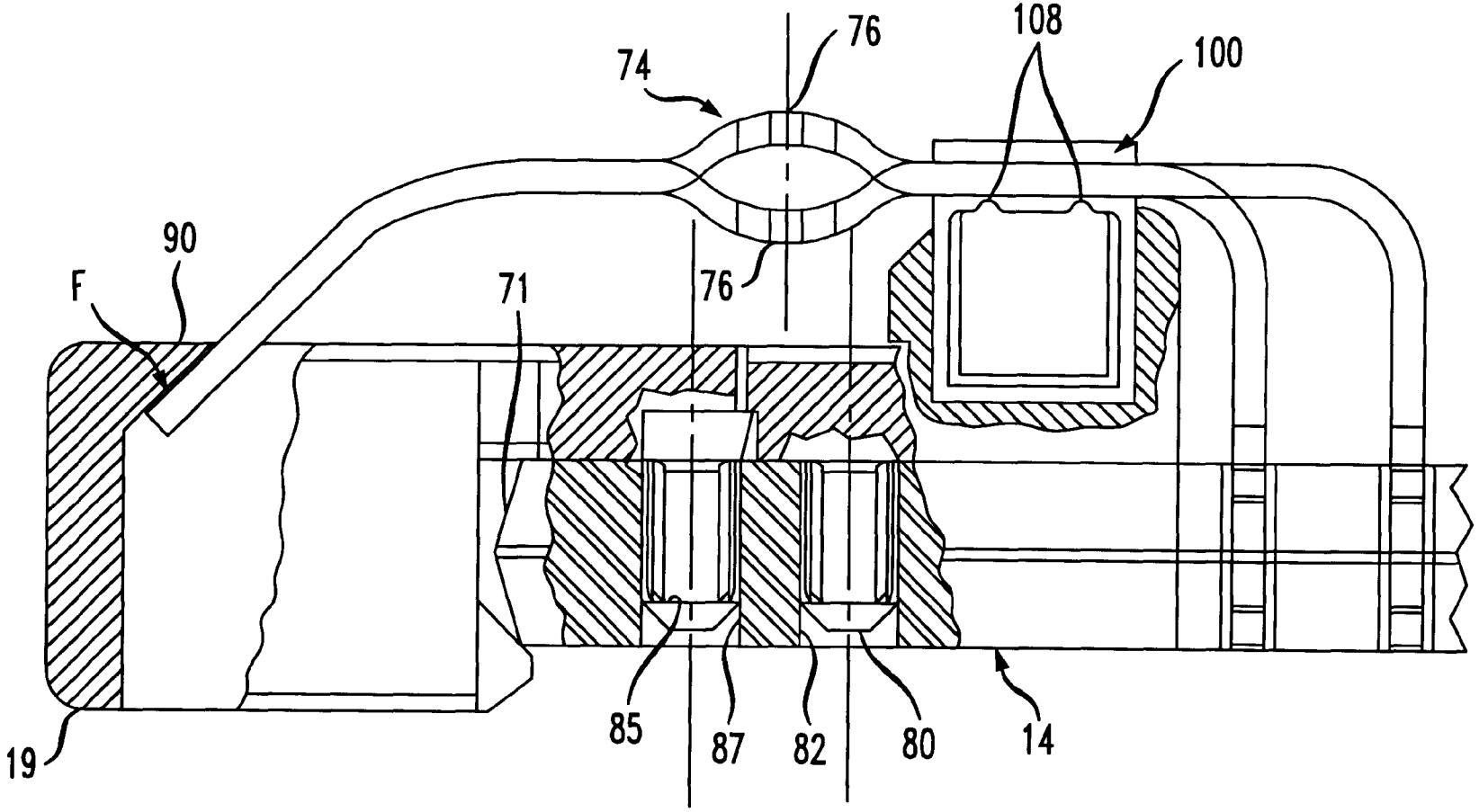
FIG. 3 is a side view, partly in section, of the front portion of the connector assembly in FIG. 2.

A second support part 19 is fixed to a front end of the first support part 17, and projects in a forward direction from the wire board 14, as shown in FIGS. 1 and 3. The second support part 19 of the guide structure has a number of parallel channels opening in the top surface 15, for preloading and for guiding the free end portions of corresponding contact wires, as shown in FIGS. 1–3.

The contact wires are formed and arranged to deflect resiliently toward the top surface 15 of the guide structure 16, when free end portions 70*a* to 70*h* of the wires are engaged by a mating connector along a direction parallel to the top surface. The material forming the terminal contact wires 18*a*–18*h* may be a copper alloy, e.g., spring-tempered phosphor bronze, beryllium copper, or the like. A typical cross-section of the terminal contact wires 18*a*–18*h* is 0.015 inches square.

The wire board 14 may incorporate conductive traces, electrical circuit components or other devices arranged to compensate for connector-induced crosstalk. Such devices can include wire traces printed within layers of the board, such as are disclosed in the mentioned '741 application. Any crosstalk compensation provided by the board 14 may be in addition to, and cooperate with, an initial stage of crosstalk compensation provided by the terminal contact wires 18*a*–18*h* and the contact wire guide stricture 16 on the board 14, as explained below.

The terminal contact wires 18*a*–18*h* have upstanding base portions 20*a*–20*h* that are electrically connected at one end to conductors associated with the wire board 14. For example, contact leg or "tail" ends of the base portions 20*a*–20*h* may be soldered or press-fit into corresponding plated terminal openings in the board 14, to connect with conductive traces or other electrical components on or within one or more layers of the board 14.

The base portions 20*a*–20*h* connect with the board 14 with an alternating offset in the long direction of the contact wires 18*a*–18*h*. This offset configuration is necessary to allow a relatively close center-to-center spacing of, e.g., 0.040 inches between adjacent free end portions of the contact wires, without requiring the same close spacing between adjacent plated terminal openings in the board 14. Otherwise, adjacent terminals on the board may "short" with one another. While the offset configuration of the contact wire base portions 20*a*–20*h* shown in FIGS. 1 and 2 provides satisfactory results, other configurations may also be acceptable. For example, an alternating "saw-tooth" pattern where three or more consecutive terminal openings in the board 14 are aligned to define an edge of each tooth, may also offer acceptable performance in certain applications. Accordingly, the illustrated offset pattern is not to be construed as a limitation in the manufacture of the connector assembly 10, as long as adjacent plated terminal openings in board 14 are spaced far enough apart to prevent electrical shorting.

The wire board 14 has a wire connection terminal region 52 (FIG. 1) at which outside, insulated wire leads are connected to an array of contact terminals (not shown) located in the region 52. Such terminals may be so-called insulation displacing connector (IDC) terminals each of which has a leg part connected to a conductive trace on the board 14, which trace is associated with one of the terminal contact wires 18*a*–18*h*. The wire connection terminal region 52 may be enclosed by a terminal housing on the top side of the board 14, and a cover on the bottom side of the board. See co-pending patent application Ser. No. 08/904,391 filed Aug. 1, 1997, and assigned to the assignee of the present invention and application. All relevant portions of the '391 application are incorporated by reference herein.

As seen in FIGS. 2 & 3, the free end portions 70*a*–70*h* of the terminal contact wires have a downwardly arching configuration, and project beyond a front edge 71 of the wire board 14. The free end portions 70*a*–70*h* are supported in cantilever fashion by the base portions 20*a*–20*h* of the contact wires, wherein the base portions are supported by the board 14. The free end portions of the contact wires define a line of contact 72 (FIG. 2) transversely of the contact wires, and the wires make electrical contact with a mating connector at points along line of contact 72. When the contact wires 18*a*–18*h* engage corresponding terminals of a mating connector, the free end portions 70*a*–70*h* cantilever in the direction of the top surface of the contact wire guide structure 16, i.e., toward the wire board 14.

In the following disclosure, pairs of the eight terminal contact wires 18*a*–18*h* are sometimes referred to by pair numbers, from wire pair no. 1 to pair no. 4, as follows.

| Pair No. | Terminal Contact Wires |
|---|---|
| 1 | 18d, 18e |
| 2 | 18a, 18b |
| 3 | 18c, 18f |
| 4 | 18g, 18h |

As seen in FIGS. 1–3, pair nos. 1, 2 and 4 of the terminal contact wires have cross-over sections 74, at which each contact wire of a given pair steps toward and crosses above or below the ther contact wire of the pair, with a generally "S"-shaped side-wise step 76. The terminal contact wires are also curved arcuately above and below their common plane at each cross-over section 74, as shown in FIG. 3. Opposing faces of the steps 76 in the contact wires are spaced apart typically by about 0.035 inches (i.e., enough to prevent shorting when the terminal wires are engaged by a mating connector). A typical length of each cross-over section in the long direction of the terminal contact wires, is approximately 0.144 inches.

The cross-over sections 74 in the terminal contact wires 18*a*–18*h* serve to initiate inductive crosstalk compensation coupling among the contact wires, in a region where the wires are co-planar. See the earlier-mentioned '506 application. This region extends from a center line of the cross-over sections 74 to points where alternate ones of the terminal contact wires bend toward the wire board 14. The remaining terminal contact wires continue to extend above the board 14 to form the mentioned offset, until they too bend toward the board 14. The length of the co-planar region of inductive crosstalk compensation is, e.g., approximately 0.180 inches.

In the illustrated embodiment, the cross-over sections 74 are provided on pair nos. 1, 2 and 4 of the eight terminal contact wires 18*a*–18*h*. The "pair 3" contact wires, i.e., wires 18*c*, 18*f*, straddle contact wire pair 1 (contact wires 18*d*, 18*e*) and no cross-over section is formed in the contact wires 18*c*, 18*f*. That is, each of the contact wires 18*c*, 18*f*, extends above the wire board 14 without a side-wise step. Pairs of terminal contact wires having the cross-over sections 74 are disposed at either side of each of the "straight" contact wires 18*c*, 18*f*.

The cross-over sections 74 are relatively close to the line of contact 72. A typical distance between the line of contact 72 and a center line of the cross-over sections 74, is approximately 0.149 inches. Accordingly, inductive crosstalk compensation by the connector assembly 10 starts near the line of contact 72, beginning with the cross-over sections 74.

Further details of the contact wire guide structure 16 in FIGS. 1–3, now follow. The first support part 17 of the structure 16 has a generally "L"-shaped profile, and is mounted on a front portion of the wire board 14 next to the terminal region 52. The support part 17 is secured on the top surface of the board by one or more ribbed mounting posts 80 that are press fit into corresponding openings 82 formed in the board 14. See FIG. 3.

An elongated, generally rectangular block 84 projects upward from a rear end portion of the support part 17. The block 84 forms, e.g., eight substantially evenly spaced-apart openings or slots 86 that open in a top surface of the block. Each slot 86 is located in the block 84 to receive a section of a corresponding one of the terminal contact wires 18*a*–18*h*. Components associated with the block 84 function to produce or inject an initial stage of capacitive crosstalk compensation coupling between sections of selected ones of the terminal contact wires, as explained further below.

The second support part 19 acts to apply a certain pre-load bias force F on the free end portions of the terminal contact wires, in the direction of the arrow in FIG. 3. The part 19 also has associated ribbed mounting posts 85 that are press fit into corresponding holes 87 formed in the board 14, near the board front edge 71 as shown in FIG. 3.

Eight parallel channels 89 are cut in the top surface of the second support part 19. The channels 89 are located to align with and receive corresponding free end portions 70*a*–70*h* of the terminal contact wires, and to guide the free end portions when they are deflected by the action of a mating plug connector. A front end portion 90 of the second support part 19 is configured to apply the pre-load bias force F to the free end portions of the contact wires in each of the channels 89, as shown in FIG. 3.

As mentioned, the block 84 of the first support part 17 has associated components that produce capacitive coupling between sections of certain terminal contact wires, for the purpose of capacitive crosstalk compensation. A cross-section view through one of the contact wire slots 86 in the block 84, is shown in FIG. 3. To suppress crosstalk between terminal contact wire pair nos. 1 and 3, larger values of capacitive coupling are needed between adjacent sections of the terminal contact wires 18*c* & 18*e*, and between sections of the wires 18*d* & 18*f*; with respect to any capacitance coupling introduced between sections of the remaining wires in the slots 86. An additional stage or stages of crosstalk compensation on the wire board 14 may then be provided in a manner disclosed, for example, in the mentioned U.S. patent application Ser. No. 08/923,741. Such additional stage or stages may then effectively cancel or substantially reduce crosstalk that would otherwise be present at output terminals of the assembly 10 corresponding to the terminal contact wire pair nos. 1 and 3.

Increased capacitive coupling between adjacent sections of contact wire pair nos. 1 and 3 in the slots 86, is produced by a pair of compensation plate capacitors 100 that are supported by the block 84. Dielectric portions of the capacitors 100 form walls between those slots 86 in which adjacent sections of wires 18*c* & 18*e*, and 18*d* & 18*f*, are contained. The plate capacitors 100 are aligned with and connect electrically to the mentioned contact wire sections when the connector assembly 10 is engaged by a mating connector, as explained below. Thus, capacitive crosstalk compensation coupling is injected relatively close to the line of contact 72, and to the crossover section 74 of contact wire pair no. 1.

Figure 4:
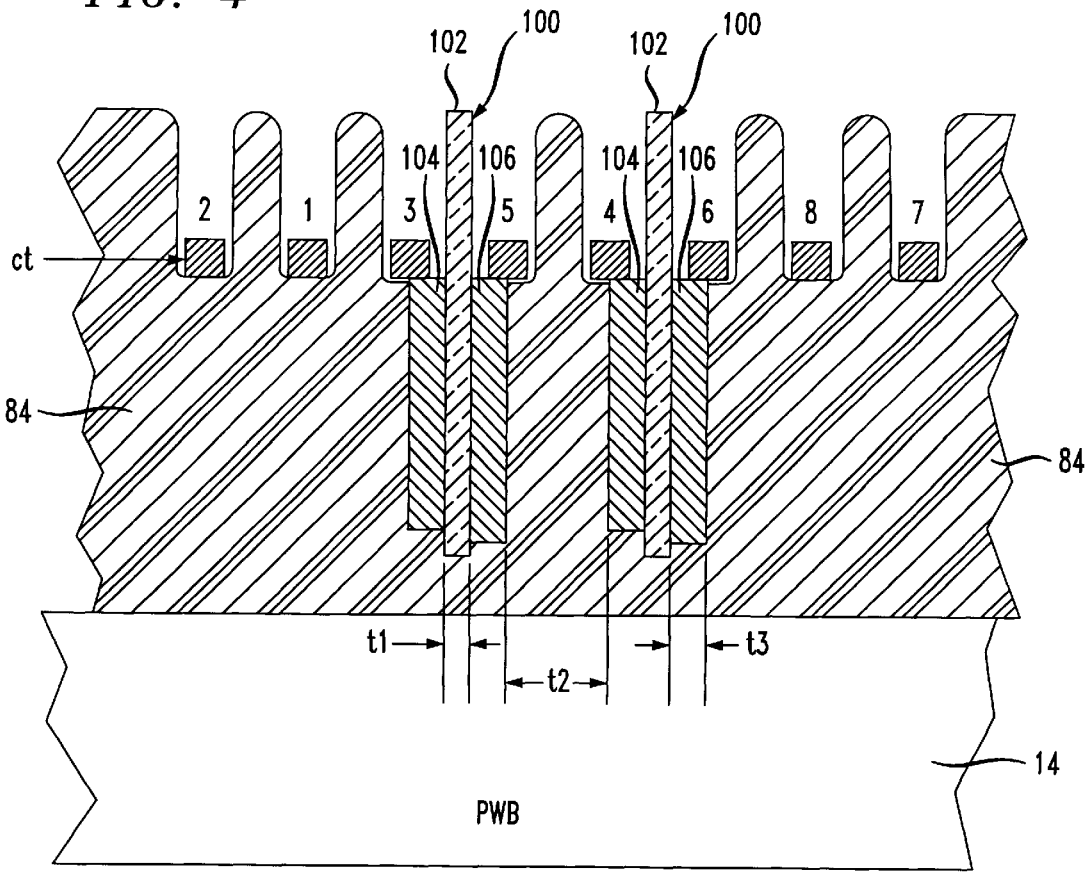
FIG. 4 is a sectional view of the connector assembly, as taken along line 4—4 in FIG. 3.

Each of the plate capacitors 100 comprises a generally rectangular base dielectric 102 of, for example, a polyamide film material having a dielectric constant ($\epsilon$) of about 3.5. An upper portion of the dielectric 102 also forms a partition wall between adjacent slots 86 in the block 84, as seen in FIG. 4. A pair of electrically conductive capacitor plates 104, 106, are deposited or otherwise adhered on opposite sides of the base dielectric 102. In the illustrated embodiment, capacitor plate 104 has less area then capacitor plate 106. Thus, precise alignment between the plates 104, 106, is not necessary to obtain a desired value of capacitance. That is, the capacitive coupling produced by each capacitor 100 is a function of the area of the smaller plate 104, and a slight misalignment of the plates 104, 106, relative to one another will not vary the capacitance value which is expressed by the following equation:

$$C = \frac{\epsilon A}{4\pi(t_1)\times 9\times 10^5}\mu^F \qquad \text{(Eq. 1)}$$

wherein:

$\epsilon$=dielectric constant of base dielectric 102

A=area of conductive plate 104 in square centimeters $t_1$=thickness of base dielectric 102 in centimeters Each of the capacitor plates 104, 106, has one or more points of contact or "bumps" 108 along a top edge of the plate. See FIG. 3. The thicknesses (in FIG. 4) of the plates 104, 106, are such that the corresponding contact wire sections will make satisfactory electrical contact with the bumps 108 on the plates when a mating connector causes the wire sections to be urged downward within the slots 86, as viewed in FIGS. 3 and 4. The bumps 108 assure a good contact between the plates 104, 106, and the cooperating sections of terminal contact wires. The bumps 108 may, for example, be curved sharply at the top so as to cause any foreign material to be dislodged when a contact wire section is urged against a point of contact on the bump.

Capacitive coupling between adjacent sections of contact wires 18*c* & 18*e*, and between adjacent sections of wires 18*d* & 18*f*, by an amount more than 14 times that produced between adjacent sections of contact wires 18*d* & 18*e* was obtained under the following conditions, wherein $t_2$ is the distance between plates 106, 104 of the two plate capacitors 100, which plates directly oppose one another in the dielectric block 84 (see FIG. 4):

$$\text{Ratio of spacing } \frac{t2}{t1} = 12.3$$

$$\text{Dielectric constant of base dielectric 102} = 3.5$$

$$\text{Dielectric constant of block 84} = 3.0$$

Figure 5:
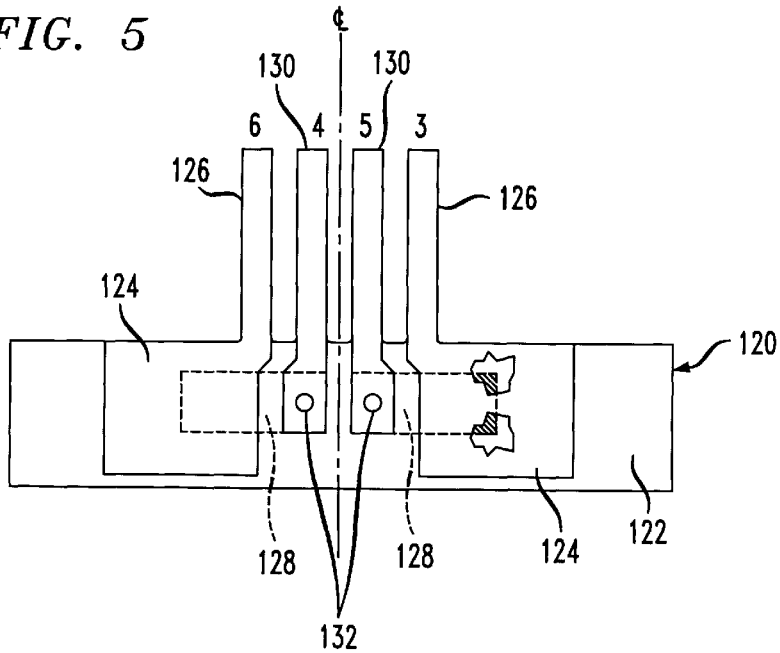
FIG. 5 is a plan view, of a plate capacitor circuit.
Figure 6:
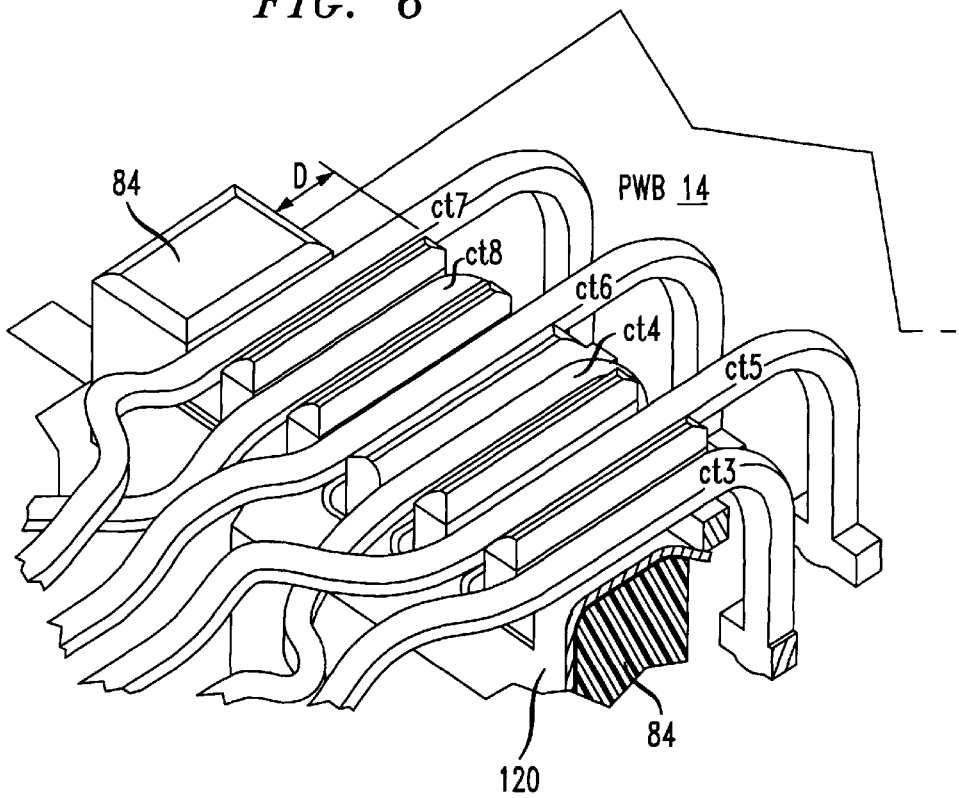
FIG. 6 is a perspective view showing the capacitor circuit of FIG. 5 mounted on the connector assembly.

FIGS. 5 and 6 show an alternative arrangement to inject capacitive coupling for crosstalk compensation between sections of certain terminal contact wires, at the block 84 on the board 14. A double-sided, flexible plate capacitor circuit 120 in FIG. 5 is formed from a generally rectangular, elongated flexible film base dielectric 122 such as, e.g., polyamide. A pair of electrically conductive capacitor plates 124 are formed on a front side of the base dielectric 122, at areas near opposite ends of the base dielectric. A pair of flexible connection strips 126 are formed with conductive material also on the front side of the dielectric 122, and the strips 126 connect electrically with the capacitor plates 124. The connection strips 126 extend substantially perpendicular to the long axis o the base dielectric 122.

Another pair of conductive capacitor plates 128 are formed on the rear side of the base dielectric 122, behind the plates 124 on the front side. The area of a rear plate 128 may be less than that of the opposed front plate 124, as long as a known area of the rear plate is fully opposed by the front plate. Thus, the plates of each set need not be precisely aligned with one another to produce a desired value of capacitance. That is, the known area of each smaller plate 128 may be used to define the capacitance value in accordance with Eq. (1), above.

A second pair of connection strips 130 are formed with conductive material on the front side of the base dielectric 122. The strips 130 extend substantially perpendicular to the axis of the base dielectric 122, and between the two connection strips 126 associated with the larger capacitor plates 124. A pair of terminal posts or vias 132 extend through the base dielectric 122 and electrically connect the ends of the strips 130 at the front side of the dielectric, to the smaller conductive plates 128 on the rear side.

FIG. 6 shows the flexible plate capacitor circuit 120 secured along a front wall of the dielectric block 84 on the first support part 17 of the terminal support structure 16. The connection strips 126, 130, are folded to extend horizontally along bottom surfaces of corresponding slots 86 in the block 84, beneath the sections of selected terminal contact wires. The contact wire sections thus make electrical contact with the connection strips 126, 130, when the contact wires are urged against the strips in the slots 86 by the action of a mating connector. Free ends of the strips 126, 130, may be held in place by a dielectric ledge at a back wall of the block 84. Alternatively, the strip ends may be secured against the bottom surfaces of the slots 86 with an acrylic pressure sensitive adhesive.

Figure 7:
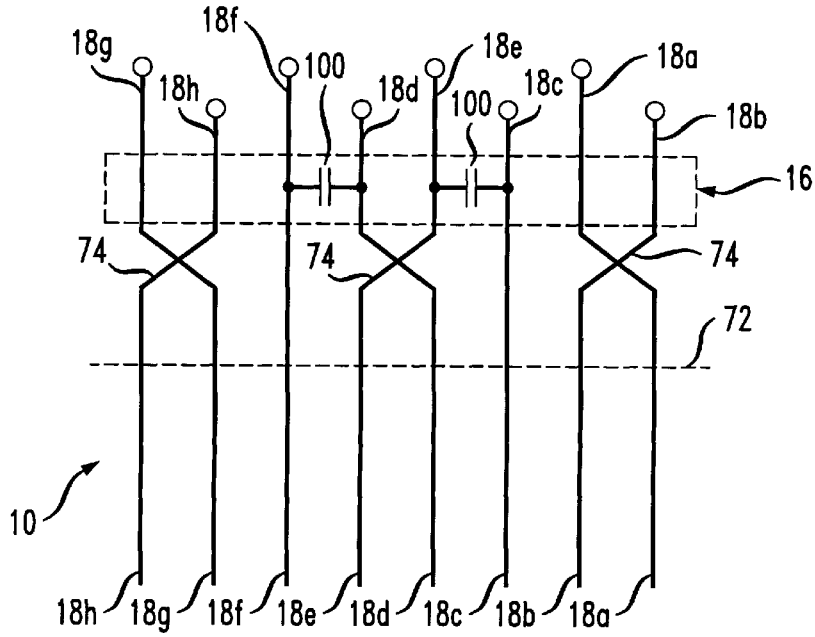
FIG. 7 is an electrical schematic representation of the connector assembly with capacitive crosstalk compensation coupling between sections of terminal contact wires.

FIG. 7 is a schematic representation of the connector assembly 10. Free end portions of the terminal contact wires 18*a*–18*h* appear beneath the line of contact 72 in FIG. 7, and cross-over sections 74 in terminal pair nos. 1, 2 and 4 appear above the line of contact 72. Plate capacitors 100 within the contact wire guide structure 16, are connected between contact wires 18*c* & 18*e*, and between contact wires 18*d* & 18*f*, just above the cross-over section 74 formed by terminal wire pair no. 1 (18*d* & 18*e*).

It is believed that Category 6 crosstalk isolation may be achieved when the connector assembly 10 is mated with an existing plug connector, if the value of each compensation plate capacitor 100 is about 2.0 picofarads (pf) and two additional stages of crosstalk compensation are provided within the wire board 14. Enhanced performance may also be obtained with the connector assembly 10 if the value of the plate capacitors 100 is about 1.2 pf and one additional stage of crosstalk compensation is provided on the board 14. If no additional crosstalk compensation is provided by the board 14, the capacitors 100 may have a value of about 0.72 pf and satisfactory performance may still be obtained.

In summary, the connector assembly 10 described and illustrated herein, provides:

(1) Enhanced capacitive crosstalk compensation coupling among selected terminal contact wires.

(2) A relatively short distance between the line of contact 72 with a mating connector, and the position of the cross-over sections 74 where co-planar inductive crosstalk compensation begins, thus minimizing signal transmission delays and improving crosstalk cancellation performance;

(3) A relatively short distance between the position of the cross-over sections 74 where co-planar, inductive crosstalk compensation begins, and the position at which capacitive compensation is injected. This also minimizes signal transmission delays and improves cross-talk cancellation; and (4) A substantial reduction in the size and complexity of additional crosstalk compensation stages that may be needed within the limited space of the printed wire board 14.

While the foregoing description represents preferred embodiments of the invention, it will be obvious to those skilled in the art that various changes and modifications may be made, without departing from the spirit and scope of the invention pointed out by the following claims.

We claim:

1. An enhanced communication connector assembly, comprising:

a wire board;

a number of elongated terminal contact wires each having a base portion supported on the wire board, a free end portion opposite said base portion for making electrical contact with a mating connector, and a section connecting the free end portion and the base portion with one another;

the free end portion is arranged so that the section of the terminal contact wire deflects by the action of the mating connector; and a first crosstalk compensating device fixed on the wire board, wherein the device is constructed and arranged to engage with the sections of selected terminal contact wires to provide capacitive compensation coupling between the selected terminal contact wires when the sections of the contact wires are deflected by said mating connector.

2. The communication connector assembly according to claim 1, wherein said crosstalk compensating device includes one or more compensation capacitors each having a dielectric base, and a pair of conductive plates on opposite sides of the base which plates are configured to contact the sections of the selected terminal contact wires.

3. The communication connector assembly according to claim 2, including a contact wire guide structure on the wire board, said structure comprising a block having openings located to receive the corresponding sections of the terminal contact wires, and the conductive plates of said compensation capacitors are aligned with the openings in said block.

4. The communication connector assembly according to claim 1, wherein said crosstalk compensating device includes compensation capacitors formed on a common dielectric base, and including flexible capacitor connection strips extending from the dielectric base wherein the connection strips are configured to contact the sections of the selected terminal contact wires.

5. The communication connector assembly according to claim 4, including a contact wire guide structure on the wire board, said structure comprising a block have openings located to receive the corresponding sections of the terminal contact wires, and the connection strips of the compensation capacitors are seated in the openings in said block.

6. The communication connector assembly according to claim 1, including a second crosstalk compensating device for producing inductive compensation coupling among selected ones of the terminal contact wires.

7. The communication connector assembly according to claim 6, wherein said second crosstalk compensating device includes at least one pair of terminal contact wires that are formed with opposed cross-over sections.

8. The communication connector assembly of claim 1, including a contact wire guide structure on the wire board, said structure comprising a block having openings located to receive the corresponding sections of the terminal contact wires, and connection terminals of said first crosstalk compensating device are supported within the openings in said block.

9. An enhanced communications jack connector, comprising:

a jack housing having a front surface and a plug opening in said front surface, wherein the plug opening has an axis and is formed to receive a mating plug connector; and a communication connector assembly inserted in said jack housing for making electrical contact with said mating plug connector when the plug connector is inserted along the axis of the plug opening in the jack housing, said connector assembly comprising;

a wire board supported in the jack housing;

a number of elongated terminal contact wires each having a base portion supported on the wire board, a free end portion opposite said base portion for electrically contacting a corresponding terminal of the mating plug connector, and a section connecting the free end portion and the base portion with one another;

the free end portion is configured so that the section of the terminal contact wire deflects by the action of the mating plug connector; and a first crosstalk compensating device fixed on the wire board, wherein the device is constructed and arranged to engage with the sections of selected terminal contact wires to provide capacitive compensation coupling between the selected terminal contact wires when the sections of the contact wires are deflected by said mating plug connector.

10. The communications jack connector according to claim 9, wherein said crosstalk compensating device includes one or more compensation capacitors each having a dielectric base, and a pair of conductive plates on opposed sides of the base which plates are configured to contact the sections of the selected terminal contact wires.

11. The communications jack connector according to claim 10, including a contact wire guide structure on the wire board, said structure comprising a block having openings located to receive the corresponding sections of the terminal contact wires, and the conductive plates of said compensation capacitors are aligned with the openings in said block.

12. The communications jack connector according to claim 9, wherein said crosstalk compensating device includes compensation capacitors formed on a common dielectric base, and including flexible capacitor connection strips extending from the dielectric base wherein the connection strips are configured to contact the sections of the selected terminal contact wires.

13. The communications jack connector according to claim 12, including a contact wire guide structure on the wire board, said structure comprising a block having openings located to receive the corresponding sections of the terminal contact wires, and the connection strips of the compensation capacitors are seated in the openings in said block.

14. The communications jack connector according to claim 9, including a second crosstalk compensating device for producing inductive compensation coupling among selected ones of the terminal contact wires.

15. The communications jack connector according to claim 14, wherein said second crosstalk compensating device includes at least one pair of terminal contact wires that are formed with opposed cross-over sections.

16. The jack connector of claim 9, including a contact wire guide structure on the wire board, said structure comprising a block having openings located to receive the corresponding sections of the terminal contact wires, and connection terminals of said first crosstalk compensating device are supported within the openings in said block.

* * * * *